United States Patent [19]

Fuchs et al.

[11] Patent Number: 4,484,981

[45] Date of Patent: Nov. 27, 1984

[54] PAPERMAKING DEWATERING APPARATUS HAVING WIRE SUPPORT MEANS WITH COOLING WATER FEED MEANS

[75] Inventors: Karl-Dieter Fuchs, Ebersbach/Fils; Ulrich Krohn, Leonberg, both of Fed. Rep. of Germany

[73] Assignee: Feldmühle Aktiengesellschaft, Dusseldorf, Fed. Rep. of Germany

[21] Appl. No.: 401,705

[22] Filed: Jul. 26, 1982

[51] Int. Cl.[3] ..... D21F 1/30; D21F 1/34

[52] U.S. Cl. ..... 162/252; 162/275; 162/352; 162/374

[58] Field of Search ..... 162/352, 374, 275, 310, 162/297, 252, 308

[56] References Cited

U.S. PATENT DOCUMENTS

| | | | |
|---|---|---|---|
| 2,170,109 | 8/1939 | Berry | 162/352 |
| 2,714,839 | 8/1955 | Mazer | 162/297 |
| 4,011,131 | 3/1977 | Nicholson | 162/275 |
| 4,164,442 | 8/1979 | Bartelmuss | 162/352 |
| 4,176,005 | 11/1979 | Bubik et al. | 162/300 |

*Primary Examiner*—Steve Alvo

*Attorney, Agent, or Firm*—Toren, McGeady and Stanger

[57] ABSTRACT

Apparatus for processing paper wherein a pair of endless curved wire devices operate to pass therebetween a sheet material to be treated for a dewatering operation or the like. A support structure in the form of individual support segments made from sintered oxide ceramics are arranged to extend over the width of the apparatus and are in contact with one another, with a plurality of the segments being arranged consecutively in the direction of the course of the wire devices, the segments having a maximum linear expanse of 700 mm per segment and having junction areas between consecutively arranged segments defining a gap for feeding cooling water to the guide wire devices.

5 Claims, 4 Drawing Figures

29
15
1
28
12
3
25
21
17
14
35
34
19
4
27
18
5
20
6
22
13
16
33

PAPERMAKING DEWATERING APPARATUS HAVING WIRE SUPPORT MEANS WITH COOLING WATER FEED MEANS

The present invention relates generally to paper treating apparatus and more particularly to a paper machine having a guide wire device which is curved in the wet area of the treatment mechanism.

The machine of the type to which the present invention relates provides dewatering elements and support elements under the wire, with the support elements being made of sintered oxide ceramics in the form of individual contacting segments which extend over the width of the paper machine.

Modern paper machines operate at very high running speeds wherein the guide wire of the machines may reach speeds of up to 800 to 1,000 m/min or more. In order to reduce to a significant extent the enormous wear on the wire and wear on the lining which occur at such speeds, these machines are generally equipped with ceramic elements for dewatering and support. The wire moves or slides with high speed over the support elements and water will penetrate at these locations through the wire. The fiber suspension which emerges from a flow box of the machine and runs onto the wire is very rapidly dewatered so that after relatively short distances, the fiber suspension is already dewatered to an extent that it may be removed from the wire as a continuous web.

The wire as such undergoes stress and a certain friction occurs between the wire and the dewatering and support elements. This friction is considerably reduced by means of the water which penetrates the wire. However, in twin wire machines, wherein a pair of endless wire devices rotate with the same speed for further dewatering with the fiber suspension therebetween, there occurs an increase in the friction due to the resulting strong contact pressures. In these type of machines, dewatering occurs toward both sides, i.e., upwardly through the upper wire device and downwardly through the lower wire device.

The high speed of the paper treating machine requires high tensioning of the guide wire thereby causing considerable difficulties during start-up and operation of the machine. During start-up of the machine, there has not yet accumulated sufficient water which will be available to penetrate through the guide wire or which may be pressed through the wire. During operation, an analagous state occurs in that sufficient water may no longer be available. In both cases, the friction between the wire and the linings of the dewatering elements and support elements will increase.

As a result of this, a sort of dry-run operation occurs which permits temperatures to increase over 100° C. In the relatively narrow foil strips over which the bottom wire extends horizontally, the friction is not as yet so negative because the friction force is small. These narrow foil strips have, as viewed in the direction of the course of the machine, a width of about 20 to 80 mm of which only a few millimeters are in direct contact with the paper machine wire. The foil strip acts as a suction box and draws the available traces of water downwardly, i.e., for a more or less short time there occurs a sufficient lubrication between the paper machine wire and the foil strip. The behavior in the area of wet suction boxes is analagous. However, the supporting elements which serve merely to guide and support the wire and which, in the direction of the course of the wire, have a considerable closed surface so that there is no dewatering through the gaps and therefore the support elements do not have this water lubrication. This applies particularly in the formation shoe for the aforementioned twin wire machines. Exactly the opposite occurs because here the wire is bent and due to this radius of curvature any possible existing water will be directed upwardly by centrifugal forces.

Since the formation shoe, as viewed in the direction of the course of the wire, has a length of 1.5 meters or more, i.e., a multiple, for example, of the foil strips, considerable temperatures will occur at this point.

Ceramics as such are capable of withstanding temperatures higher than those occurring in this environment. However, two additional factors give rise to serious problems. First, ceramics have a completely different coefficient of expansion than the support or carrier material, i.e., steel arranged below the ceramics. Secondly, ceramics are sensitive to thermal shock. This sensitivity increases with increase in the dimensions of the ceramic parts. Since during the start-up of the paper machine, the machine wire must first be started before the fiber suspension can be added, a dry friction initially results of necessity, thereby leading to heating of the ceramic support elements and of the dewatering elements. Subsequently, a sudden cooling due to the introduction of water will occur. As a result, microcracks and possibly also macrocracks form in the ceramics lining, particularly in the area of the formation shoe because this part is the largest supporting element.

The present invention is therefore directed toward the provision of an apparatus wherein there arises the capability of reducing friction, particularly when utilizing plastic wires, and to exclude or prevent thermal shock to the extent possible.

SUMMARY OF THE INVENTION

Briefly, the present invention may be described as a paper machine comprising curved guide wire means adapted to pass sheet material to be treated therethough, dewatering elements operatively associated with said guide wire means, and support means in the form of individual support segments made from sintered oxide ceramics which extend over the width of the machine and are in contact with one another, with a plurality of said segments being arranged consecutively in the direction of the course of the guide wire means, said segments having a maximum linear expanse of 700 mm per segment and having junction areas between said consecutively arranged sections defining a gap for feeding cooling water to said guide wire means, said machine further comprising cooling water feeding means for feeding the cooling water through the gap.

The invention provides significant advantages in paper machines, particularly in a paper machine with a curved guide wire device in the wet area in which under the wire dewatering elements and support elements of sintered oxide ceramics in the form of individual segments are provided with the individual segments being in contact with one another and extending over the width of the machine. The particular characterizing features of the invention involve an arrangement wherein several segments are arranged in series in the direction of the course of the guide wire with the segments having a maximum linear expansion of 700 mm per segment, with the junction areas between the consecutively arranged segments forming a gap for feeding the cooling water to the wire.

By dividing the formation shoe and by means of the gap in at least two segments, the limitation of the linear expanse to a maximum of 700 mm in the direction of the course of the wire, there occurs a reduction in the sensitivity of the ceramics against thermal stresses. Additionally, by arranging a gap between the individual segments, viewed in the direction of the course of the wire, cooling of the segments is possible. This cooling effect is achieved by means of cooling water which is passed under pressure through the gap and by means of which in addition to a cooling effect, simultaneous lubrication of the wire is achieved. Thus, there also occurs in the start-up phase a condition which automatically results after start-up due to the penetration of water from the fiber suspension.

In a preferred embodiment of the invention, the segments are connected in the area of the gap with a support and they are sealed with respect to the support. Due to this sealing, in the area of the gap between the support and the segments, a hollow space results which can be provided directly with water under pressure so that the water will emerge upwardly through the gap over the entire width of the paper machine.

In another preferred embodiment of the invention, a spraying pipe is arranged below the gap. The gap is formed by the segments and extends over the widths of the paper machine and the spraying pipe is thus arranged with a length which essentially corresponds to the width of the paper machine. The spraying pipe is provided with bores or it may be equipped with nozzles wherein the nozzles are advantageously constructed as flat jet nozzles. The arrangement of a spraying pipe enables a more exactly measured output of cooling water. At the same time, the selection of a gap having a greater width is possible without resulting in negative effects on the sheet forming function. The flat jet nozzles on the spraying pipe are inserted in such a manner that they will form a wider water jet so that the entire wire width will be covered.

The water pressure of the water which is sprayed onto the wire is preferably between 1 and 10 bar. The quantity of water provided is between 5 to 25 liters per minute per meter of gap length.

In a further preferred embodiment of the invention, it is provided that the cooling water is controlled by means of a cooling control device which consists of at least detecting or sensing element, a converter, a transmitter, a valve, and a pump with a feed line. This ensures automatic control of the entire paper machine. The detecting element, which may be constructed either as a thermal detecting element or as a moisture detecting element, transmits a signal to the transmitter when the water film on the guide wire is significantly reduced or the temperature of the guide wire increases. A valve is then opened by means of the converter and transmitter so that a pump may operate to feed water through a feed line to the endangered area and the water may be sprayed through the gap onto the wire.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
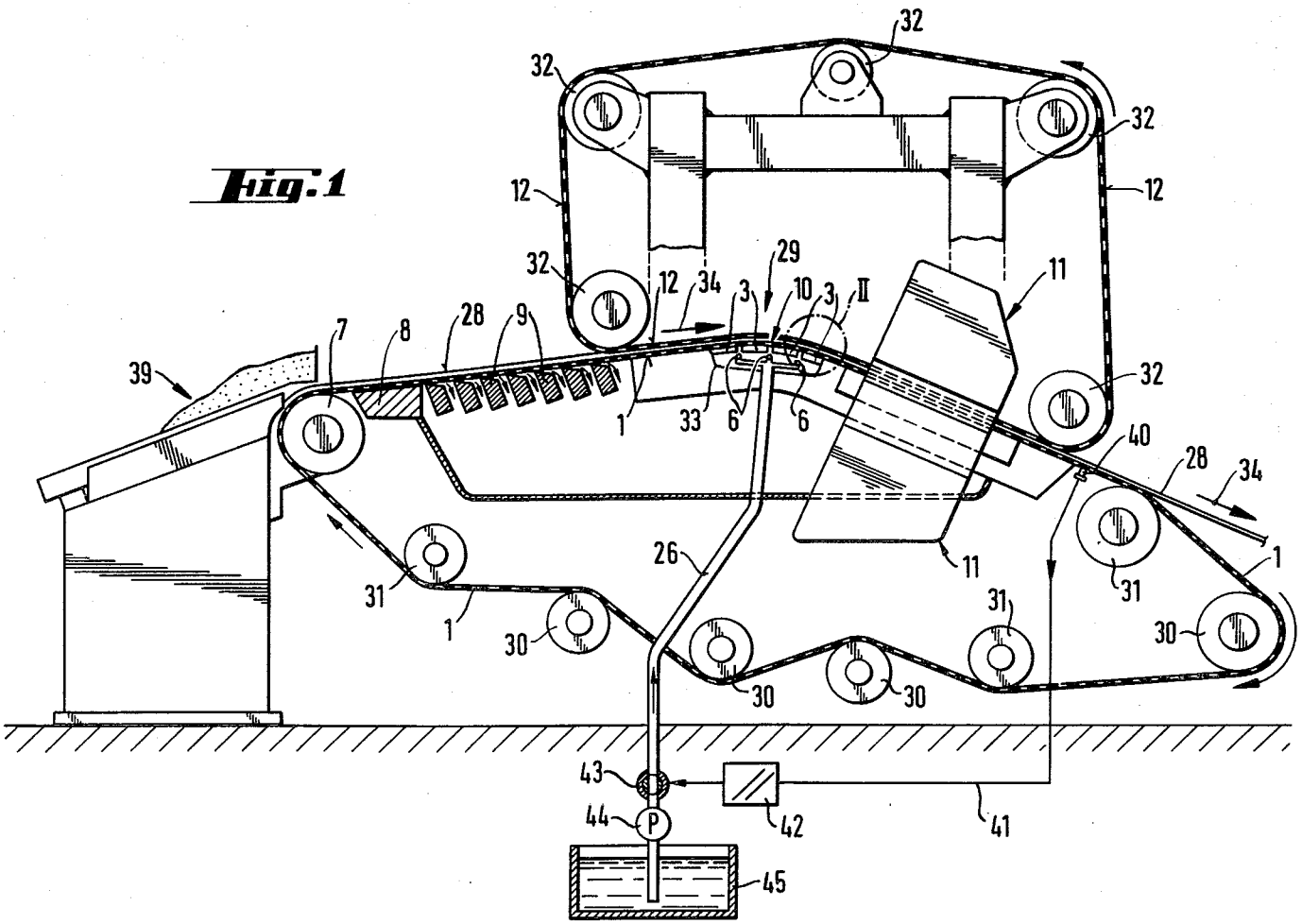
FIG. 1 is a sectional diagram showing a rapidly running paper machine having a twin wire arrangement with a curved wire course.

Referring now to the drawings, wherein similar parts are identified with like reference numerals in the various figures thereof, the apparatus of the invention is generally depicted in FIG. 1 which shows a paper treatment machine basically comprising an upper wire mechanism including an upper wire 12 and a lower wire mechanism including a lower or bottom wire 1. As will be seen from FIG. 1, the bottom wire 1 essentially comprises an endless loop which runs over a front roller 7 and which passes over a wire frame 8 and subsequently through foil strips 9. In this area, the bottom wire 1 extends essentially in a linear direction and rises slightly.

The wire 1 then reaches a curved area 29 where it is supported by a formation shoe 10 after which an area including suction boxes 11 follows from where the wire, guided by means of additional tensioning and guide rollers 30, 31, returns to the front roller 7 or to a flow box 39.

The upper wire 12 is held by tensioning, guide, and deflection rollers 32 and is supported in its convexly curved area on the corresponding area 29 of the bottom wire 1, i.e., it reaches the underwire 1 shortly before the formation shoe 10 and extends with the underwire 1 with the same speed until it reaches an area behind the suction boxes 11.

Figure 2:
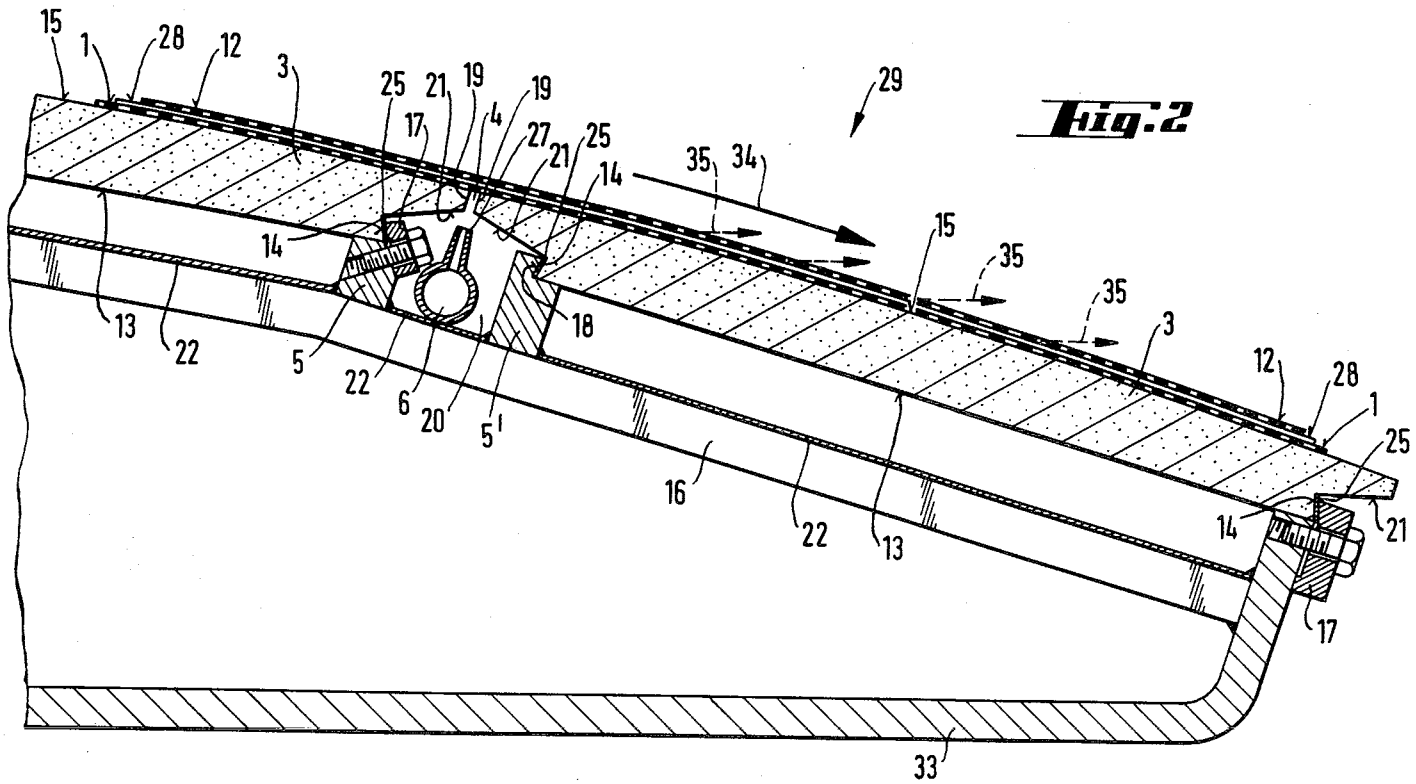
FIG. 2 is a sectional view of the area II shown in FIG. 1 depicting, in greater detail, the curved direction of the course of the wire with a first embodiment of a cooling device.

As shown in greater detail in FIG. 2, the formation shoe 10 consists of a plurality of segments 3 which are arranged in a side-by-side organization and which are located consecutively. The segments 3 are formed with a width of 300 mm and with a length of 650 mm. The segments 3 consist of sintered aluminum oxide and they have a flat base 13 which, at its narrow side extending transversely to the operating direction, changes over into a dovetail recess 14. The surface 15 of the segment 3 is curved and this curvature has a radius of between 500 to 5,000 mm. The degree of curvature depends upon the respective use of the machine which is intended and participates significantly in the dewatering output. The dewatering is shown in FIG. 2 by the arrows 35.

Figure 3:
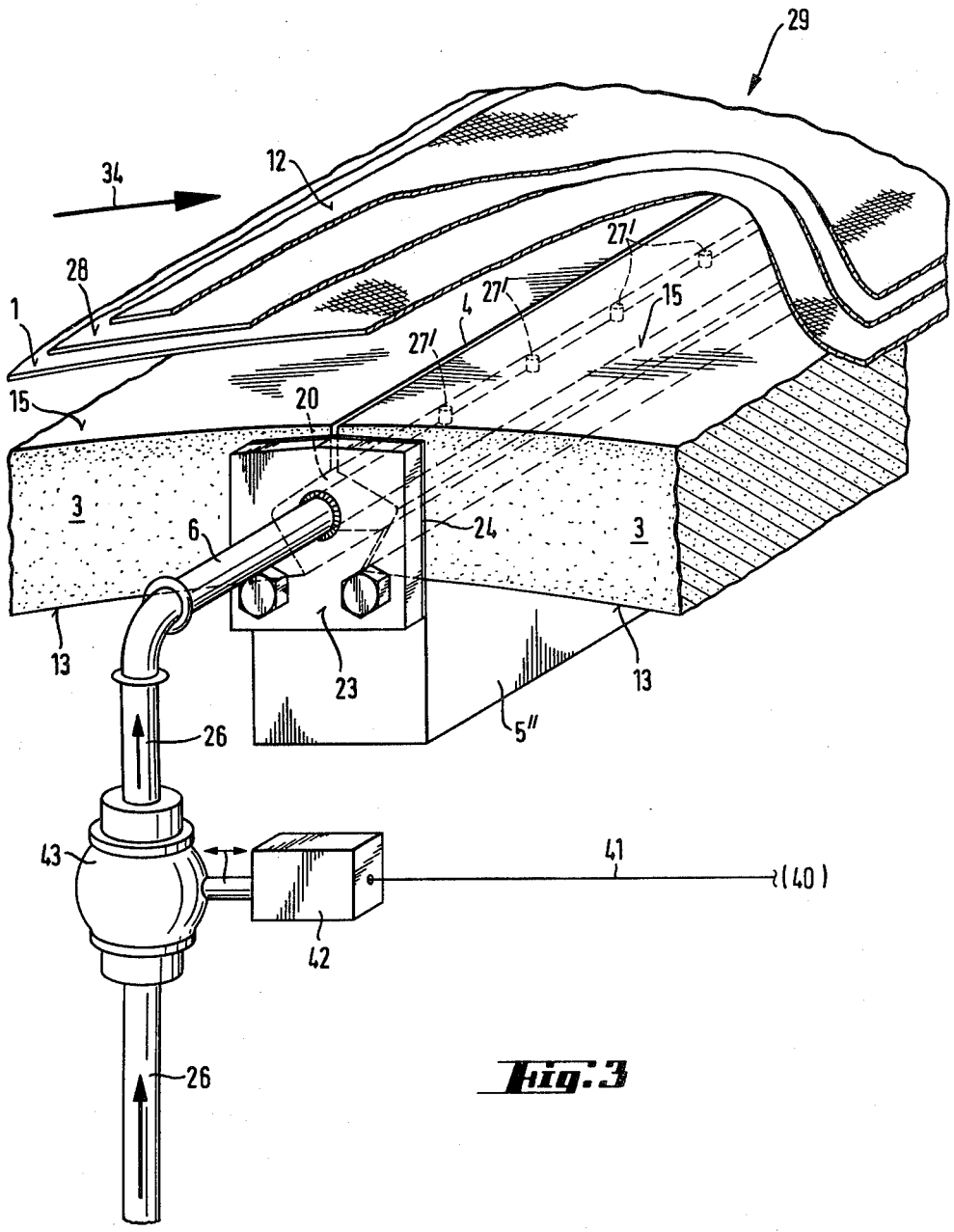
FIG. 3 is a perspective view showing in greater detail the embodiment according to FIG. 2.

The segments 3 are supported upon supports 5 which extend over the width of the machine and which rest upon supports 16 which are connected with the machine frame by means of a collecting housing 33. Fastening the segments 3 is provided on one side by means of clamping jaws 17 which are screwed to the supports 5 and which engage at the oblique surfaces of the recesses 14 of the segments 3 and press the latter into the recesses 18 of the supports 5' which are located on the opposite side. Between the narrow sides 19 of the segments 3 there remains a gap 4 which is connected or arranged in flow communication with a hollow space 20. The hollow space 20 is formed by oblique surfaces 21 of the segments 3, the supports 5, 5', 5'', and optionally also by a bottom plate 22 which may also extend completely over the supports 16. At the side of the assembly, sealing means are provided in the form of a cover piece 23 with an intermediate layer 24 which is made of rubber, as best seen in FIG. 3. An additional seal 25 is also located between the segments 3 and the supports 5, 5', and 5'' or the clamping jaws 17 so that pressurized water which is fed through a pipe 26 into a spraying pipe 6 can only emerge through the gap 4.

It will be seen in FIG. 3 that the pressurized water flowing through the pipe 26 and into the spraying pipe 6 may emerge therefrom through bores defined by elements 27'.

Figure 4:
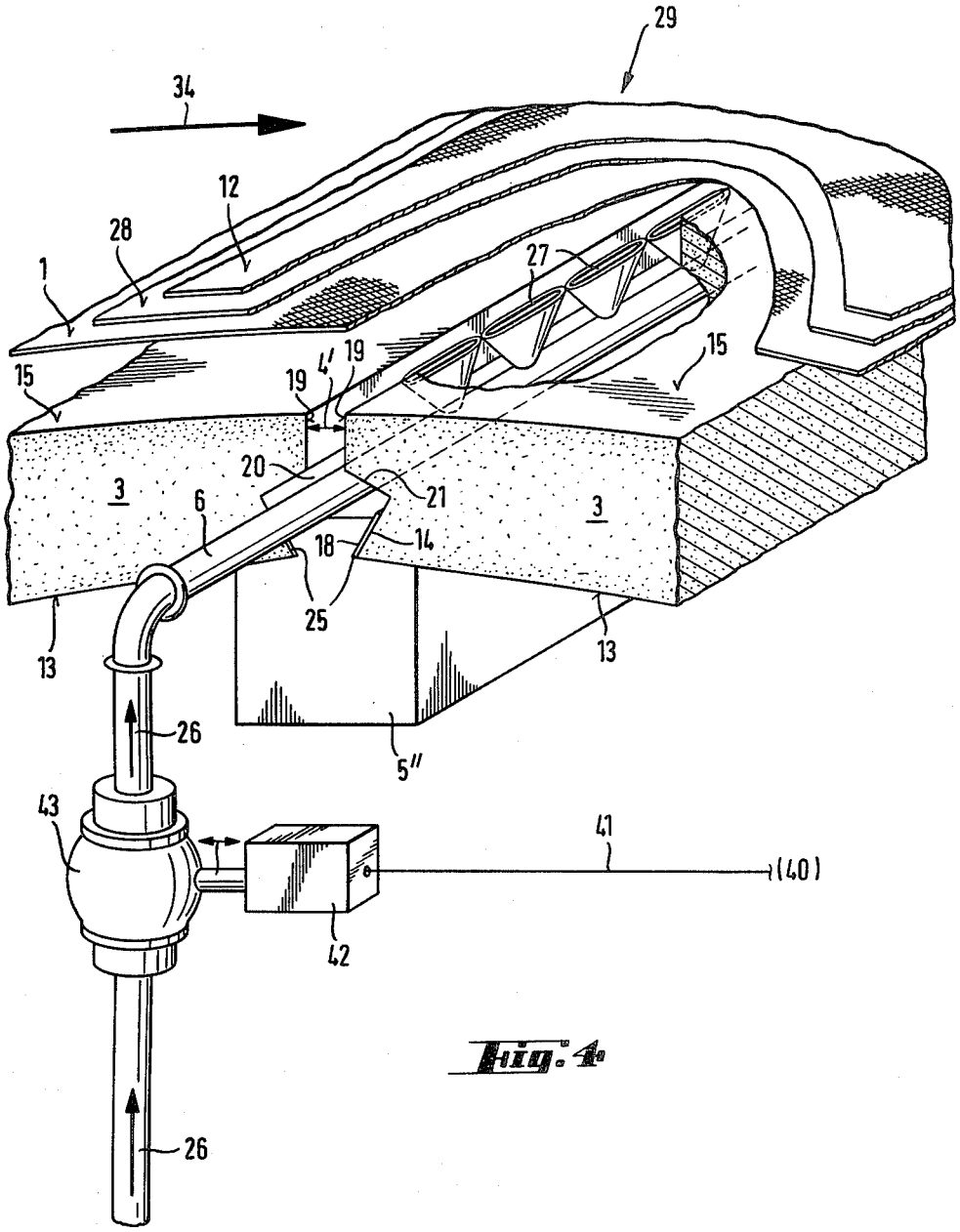
FIG. 4 is a perspective view showing another embodiment of the cooling device of the invention.

An alternative embodiment of the invention is shown in FIG. 4. In the embodiment of FIG. 4, a gap 4' is provided which is wider than the gap 4, and the spraying pipe 6 extends through the hollow space 20 beneath the gap 4. In FIG. 4, the pipe 26 is provided at uniform distances with nozzles 27. The nozzles 27 differ from the bores 27' in that they narrow upwardly in the paper machine and widen transversely to the operating direction of the machine, i.e., in the direction of the gap 4', so that the entire gap 4' is covered completely by the openings of the nozzles 27. The sectional view which is depicted in FIG. 4 is exactly the center of the formation shoe 10. In this area, the support 5 is constructed in a dovetail configuration to which the segments 3 are pressed from both sides. Over the segments 3, the underwire 1 is shown on which an already partially dewatered fiber layer 28 is arranged which is covered by the upper wire 12 and which is moved in the direction 34 indicated by the arrow depicting the course of the machine.

As shown particularly in FIG. 1, a device is provided which controls lubrication and cooling of the apparatus and thus prevents dry running thereof. This control and cooling device consists of one or more detecting elements 40 which respond to moisture and/or temperature and which are arranged at the outlet of the dewatering device.

A line 41 operates to transmit the sensed actual state detecting in the detecting elements 40 to an actual-desired-value converter and transmitter 42 which operates to regulate one or more valves 43 to provide a regulated quantity of water. The water is emitted from a container 45 and is fed to the spraying pipes 6 by means of a pump 44 located in the line 26.

Thus, it will be seen from the foregoing that the segments 3 in the area of the gap 4 are connected with the support 5 and are sealed with respect to the support 5. Below the gap 4 which is formed by the segments 3 and which extends over the width of the paper machine, there is provided a spraying pipe 6 arranged with a length that corresponds essentially to the width of the paper machine. The machine is equipped with a cooling control device which consists of at least one of the detecting elements 40 and of a converter and transmitter 42, a valve 43, a pump 44, and the feed line 26.

The machine is equipped with a curved guide wire device in the wet area thereof and thus, in accordance with the present invention, paper machines may be equipped in the dewatering area with support elements and dewatering elements of sintered oxide ceramics which are formed of combined individual segments. In the direction of the course 34 of the machine, between the junction points of two consecutively arranged segments, the gap 4, 4' is provided in order to enable feeding of cooling water. The segments 3 are connected in the area of this gap with a support and are sealed with respect to the support. Below the segments, a spraying pipe may be arranged and the water thus acts upon the paper machine wire through the gap.

While specific embodiments of the invention have been shown and described in detail to illustrate the application of the inventive principles, it will be understood that the invention may be embodied otherwise without departing from such principles.

What is claimed is:

1. A paper processing machine comprising: upper wire means and lower wire means arranged to define therebetween a gap through which there is passed in a feed direction sheet material to be treated, both said upper and lower wire means extending so as to be movable on opposite sides of said gap in the feed direction of said sheet material together wih said sheet material;

wire support means comprising a plurality of individual segments consisting essentilly of sintered oxide material which extend across the width of said paper making machine in a direction transversely to said feed direction and which are connected with one another, with a plurality of said segments being arranged consecutively in said feed direction along the course of said wire means;

dewatering elements operatively associated with said wire means located at a different location than said support means forwardly thereof taken relative to said feed direction and cooling water feed means;

said segments having a maximum linear expanse of 700 mm per segment taken along said feed direction and having junction areas between said consecutively arranged segments defining a gap for feeding to said wire means through said gap cooling water from said cooling water feed means;

said segments in the area of said gap being connected with a support and being sealed with respect to said support, said support forming a hollow space between adjacent segments below said gap with said cooling water feed means being located in the hollow space below said gap.

2. A machine according to claim 1 wherein said cooling water feed means comprise a spraying pipe arranged below said gap formed by said segments extending over the width of said paper machine, said spraying pipe being arranged with a length which corresponds essentialy to the width of said paper machine.

3. A machine according to claim 1 further comprising cooling control means including at least one detecting element, a converter and a transmitter, a valve, a pump, and a feed line for controlling said feed of cooling water.

4. A machine according to claim 2 wherein said spraying pipe is equipped with means defining generally circular bores through which spraying water is directed through said gap.

5. A machine according to claim 2 wherein said spraying device is equipped with nozzles having a generally elongated configuration extending in the direction of said gap through which cooling water is directed to said gap.

* * * * *